US006239751B1

(12) United States Patent
McRae et al.

(10) Patent No.: US 6,239,751 B1
(45) Date of Patent: May 29, 2001

(54) LOW PROFILE TUNABLE ANTENNA

(75) Inventors: Michael W. McRae, Louisville; Travis Horne, Broomfield, both of CO (US)

(73) Assignee: Ball Aerospace & Technologies Corp., Boulder, CO (US)

( * ) Notice: Subject to any disclaimer, the term of this patent is extended or adjusted under 35 U.S.C. 154(b) by 0 days.

(21) Appl. No.: 09/395,400

(22) Filed: Sep. 14, 1999

(51) Int. Cl.[7] ..... H01Q 1/38

(52) U.S. Cl. ..... 343/700 MS; 343/826; 343/853

(58) Field of Search ..... 343/700 MS, 829, 343/846, 825, 826, 853, 830, 713; H01Q 1/38

(56) References Cited

U.S. PATENT DOCUMENTS

| | | | | |
|---|---|---|---|---|
| 4,386,357 | * | 5/1983 | Patton | 343/700 MS |
| 4,495,503 | | 1/1985 | Morman | 343/746 |
| 5,294,938 | | 3/1994 | Matsuo et al. | 343/829 |
| 5,734,350 | | 3/1998 | Deming et al. | 343/700 MS |
| 5,880,697 | | 3/1999 | McCarrick et al. | 343/742 |
| 6,069,589 | * | 5/2000 | Lewis, Jr. et al. | 343/767 |
| 6,087,990 | * | 7/2000 | Thill et al. | 343/700 MS |

* cited by examiner

*Primary Examiner*—Don Wong
*Assistant Examiner*—Shih-Chao Chen
(74) *Attorney, Agent, or Firm*—Sheridan Ross P.C.

(57) ABSTRACT

A low profile or very low profile antenna having a finely tunable frequency response is provided. The antenna is easily tuned to have a precise frequency response while its protective radome is in place. The antenna generally includes a first antenna element, a second antenna element, a ground plane, and a tuning mechanism. The tuning mechanism may be accessed while the radome of the antenna is in place. The antenna is particularly well-suited for use in shipping applications, where a very low antenna profile is desirable.

19 Claims, 5 Drawing Sheets

LOW PROFILE TUNABLE ANTENNA

FIELD OF THE INVENTION

The present invention relates to radio frequency tunable antennas. In particular, the present application relates to very low profile antennas having one or more tuning elements.

BACKGROUND OF THE INVENTION

Antennas are used to radiate or receive radio wave signals. The transmission and reception of radio wave signals is useful in a broad range of activities. For instance, in the overland shipping industry, it is desirable to be able to track the exact location of goods or materials while in transit from a central location. In addition, it is desirable to be able to direct the performance of certain functions with respect to such goods from a central location. However, it is important that any antenna used in connection with such an application have a low profile so that it does not interfere with the normal functioning of, for example, the trailer or shipping container to which the antenna is affixed.

Increasingly, raw materials and finished goods are shipped by tractor trailer. A typical tractor trailer, or semi, consists of a tractor to provide motive force, and a trailer of approximately 40 feet in length that is supported at a front end by the tractor. Tractors and trailers are equipped with a standard hitching mechanism to allow interchangeability between a large number of tractors and trailers. In addition to being towed by tractors, trailers may be placed on specially adapted rail cars. Therefore, in a typical scenario, a trailer may be loaded with goods at a factory and hitched to a tractor for transport to a rail facility. The trailer may then be uncoupled from the tractor and placed on a rail car. The rail car may then carry the trailer to another rail depot where the trailer may be lifted from the rail car and interconnected with a second tractor for transport to its final destination Because of the large carrying capacity of modern trailers, and because of the large number of goods being transported in such trailers, shipping companies and the owners of goods and materials transported by tractor trailers require precise and up to date information regarding the location of their goods and materials while they are in transit. Existing methods for tracking tractor trailers include noting the location of the trailers as reported by the drivers operating the tractor to which a trailer is attached. However, such information is only as timely as the last report received from the driver. Also, such a system relies entirely upon the driver to accurately report the position and condition of the goods or materials. Furthermore, such systems offer no way for a company to track the whereabouts of a shipment that has been hijacked or stolen from a temporary storage facility.

One proposed method of tracking the location of trailers or shipping containers combines a global positioning satellite (GPS) system with a radio transmitter. Such a system allows position information as determined by the GPS receiver to be communicated to the radio transmitter, which in turn transmits the position information to a central site. Also, the transmitter may be used to communicate information regarding such things as the ambient temperature inside the trailer. Systems combining GPS receivers and radio transmitters may additionally include a radio receiver. The provision of a radio receiver allows certain commands to be transmitted from the central control site to individual trailers. Therefore, commands may be sent from the central control site to, for example, operate the refrigeration unit on trailers equipped to carry refrigerated goods. With such a system, the shipping company need not rely on the driver to operate the refrigeration unit. Another example of the usefulness of a radio receiver on a trailer is to allow central control of the locking and unlocking of a trailer. Yet another example of the advantages offered by a transmitter and receiver on a trailer is the provision of revised routing instructions to the driver through a computer interconnected to the antenna.

Where a radio antenna is to be provided on a trailer, it is desirable that such an antenna have a low or very low profile. In a typical trailer having an enclosed space for containing the items to be transported and thereby protecting them from theft and the elements, the trailer is as tall as possible given the constraints imposed by overpasses, tunnels, and applicable laws. Accordingly, any antenna structure affixed to such a trailer must not add appreciably to the trailer's height. In addition, such trailers must be capable of reliable operation in all types of weather. Therefore, it is desirable that an antenna affixed to the exterior of a trailer be protected from the elements. A further desirable attribute of an antenna to be placed on the exterior of a trailer is that it not have a deleterious effect on the aerodynamic drag of the trader. All of these requirements are met by an antenna having a low or very low profile. Furthermore, these requirements are advanced by placing the antenna within an enclosure.

With the increasing concern for saving fuel, the aerodynamics of tractor trailers have received more and more attention. One commonly adapted measure to improve the aerodynamics of enclosed trailers is to provide a sloping top surface. Therefore, trailers are commonly provided with a top that rises approximately one inch from the leading edge of the trailer to approximately 14 feet behind the leading edge of the trailer. Accordingly, at the front edge of the trailer, there is an area that is approximately one inch below the highest extent of the trailer. Therefore, if an antenna unit having a height of about one inch or less were provided, it would not add appreciably to the height of the trailer. In addition, an antenna having a height of one inch or less would have little effect on the aerodynamics of the trailer. An antenna having a small height with respect to the operating wavelength is generally known as a very low profile antenna (VLPA).

Although placing the antenna within an enclosure or radome protects the antenna from the elements and helps maintain the aerodynamics of the trailer, these enclosures affect the tuning of the antenna. Also, the placement of an antenna on a large surface, such as on the top of an enclosed trailer, also affects the tuning of the antenna. Therefore, it would be advantageous to provide a low profile or very low profile antenna that could be tuned with its radome in place. Furthermore, it would be desirable to provide such an antenna that could be tuned with consideration given to the effect the antenna's ultimate operating environment has on its tuning.

Antennas having a low or very low profile generally have a very high Q value. An antenna with a high Q value has relatively high sensitivity over a relatively narrow range of frequencies. Therefore, for such an antenna to be adequately sensitive over its intended useful frequency range, it must be precisely tuned. Generally, the operating frequency of a patch antenna element can be altered by altering the length of the element or by altering the height of the element above the ground plane.

According to an existing method for tuning antennas, the length of the antenna elements are trimmed. However, this method of tuning antennas is tedious and time consuming. Also, this method produces a large amount of waste, resulting in a messy assembly area. Furthermore, this method of tuning antennas is irreversible; an antenna that has been over-trimmed cannot be made to meet the required scations, and must generally be discarded. Additionally, such designs are incapable of being tuned with an associated radome in place, and therefore require that the person tuning the antenna anticipate the effect that installation of a radome will have on the useful frequency range of the antenna.

Other existing antenna designs that provide a tuning mechanism to obtain optimal performance have required a large number of additional components to provide tunability. For example, some such designs provide an additional ground plane, the distance of which from the antenna element is adjustable using screws and wing nuts. However, the addition of such components results in an antenna having a greatly enlarged size and complexity. In other designs, dielectric material is placed in close proximity to the antenna element to vary the load on that element and thereby tune the antenna. Such designs introduce additional complexity and result in unnecessary electrical losses. These designs are also too large for use in very low profile antenna applications.

Another existing design incorporates ribbon antenna elements located adjacent to a ground plane. One end of the ribbon-shaped element is affixed to the ground plane, while the other is held above the ground plane by a nonconductive screw. The height of the element above the ground plane may be varied by adjustment of the screw. This design requires that the ribbon element be flexible, to prevent binding of the tuning screw during the tuning process. In addition, these designs do not provide a way to tune the antenna with a radome in place. Furthermore, this design provides no protection against short circuits when the tuning screw is adjusted so that the ribbon element is in very close proximity to the ground plane. When used in an environment with significant amounts of vibration, the ribbon element can move away from the head of the tuning screw, thus allowing the antenna to lose its tuning.

For the above-stated reasons, it would be advantageous to provide a low profile or very low profile antenna that is capable of being tuned with high precision. In addition, it would be advantageous to provide such an antenna that is highly resistant to de-tuning or failure due to vibrations in the antenna's operating environment. Concomitantly, such an antenna must be reliable, inexpensive to manufacture, and easily tuned.

SUMMARY OF THE INVENTION

In accordance with the present invention, a very low profile antenna is disclosed having tunable elements. The antenna includes a first antenna element, a second antenna element, a ground plane, and at least one tuning element. The tuning element operates by varying the height of at least one end of the first and/or second antenna elements over the ground plane. The distance between the tuning elements may also be varied.

The antenna elements are generally planar, and typically have a width that is at least about 80% of the element's length. Each of the antenna elements is provided with a tuning element at a first end. At a second end, the antenna elements are electrically and mechanically interconnected to the ground plane. The distance between the first and second antenna elements is about $1/400^{th}$ of the wave length of the signal at the operating frequency of the first antenna element. Similarly, the distance between the second antenna element and the ground plane is about 1/400 the wavelength of the signal at the operating frequency of the second antenna element. In a preferred embodiment of the present invention, the assembly including the ground plane and the antenna elements is less than 1" in height.

Generally, there is a progression in size from the first antenna element to the ground plane. Thus, the first antenna element has a length and a width, and the second antenna element has a length and a width that are slightly larger than those of the first antenna element. Similarly, the ground plane has a length and a width that are slightly larger than those of the second antenna element. According to one embodiment, the width of the antenna elements and the ground plane are at least about 80% of their lengths.

In addition to the direct mechanical interconnection between the first and second antenna elements and the ground plane at a second end, and the tuning elements provided at a first end of the first and second antenna elements, the elements and the ground planes may be spaced apart using nonconductive mechanical spacers. According to one embodiment, reception and transmission signals are communicated between the antenna and the associated transceiver by a coaxial feed line. This feed line may be electrically interconnected to one of the antenna elements. The feed line may also be interconnected to another of the antenna elements through a jumper cable. The length of the jumper cable is selected to match the impedance of the antenna element to which it is interconnected with the impedance of the feed line and the transceiver circuitry.

The antenna can be provided with a radome to protect the antenna from the elements when mounted on a trailer or other shipping container. The radome also ensures that the antenna does not degrade the aerodynmic efficiency of the trailer. The antenna may be tuned by accessing the tuning elements through the bottom of the ground plane while the radome is in place. In one embodiment, the antenna is tuned with its radome in place, and while positioned on a second ground plane having dimensions that approximate those of the top of a trailer. According to this embodiment, the tuning element or elements are accessed through both the first and second ground planes while the antenna radome is in place. Once the antenna has been tuned, the tuning elements may be permanently secured in position by gluing or welding. According to one embodiment of the present invention, the antenna, with the radome in place, is less than or equal to about 1" in height.

Based on the foregoing summary, a number of salient features of the present invention are readily discerned. A very low profile antenna can be provided having a frequency that is tunable while its radome is in place. The antenna of the present invention may also be tuned in an environment that approximates that of its ultimate operating environment, enabling the antenna to be very finely tuned. Additionally, the antenna of the present invention has a very low profile and can be unobtrusively mounted on the exterior of a trailer or other shipping container. In another embodiment, where first and second tuning elements are used as separate transmit and receive elements, they can each be separately tuned to have a very precise frequency response.

Additional advantages of the present invention will become readily apparent from the following discussion, particularly when taken together with the accompanying drawings.

DETAILED DESCRIPTION

In accordance with the present invention, an antenna system having a very low profile and having tunable elements is provided.

Figure 1:
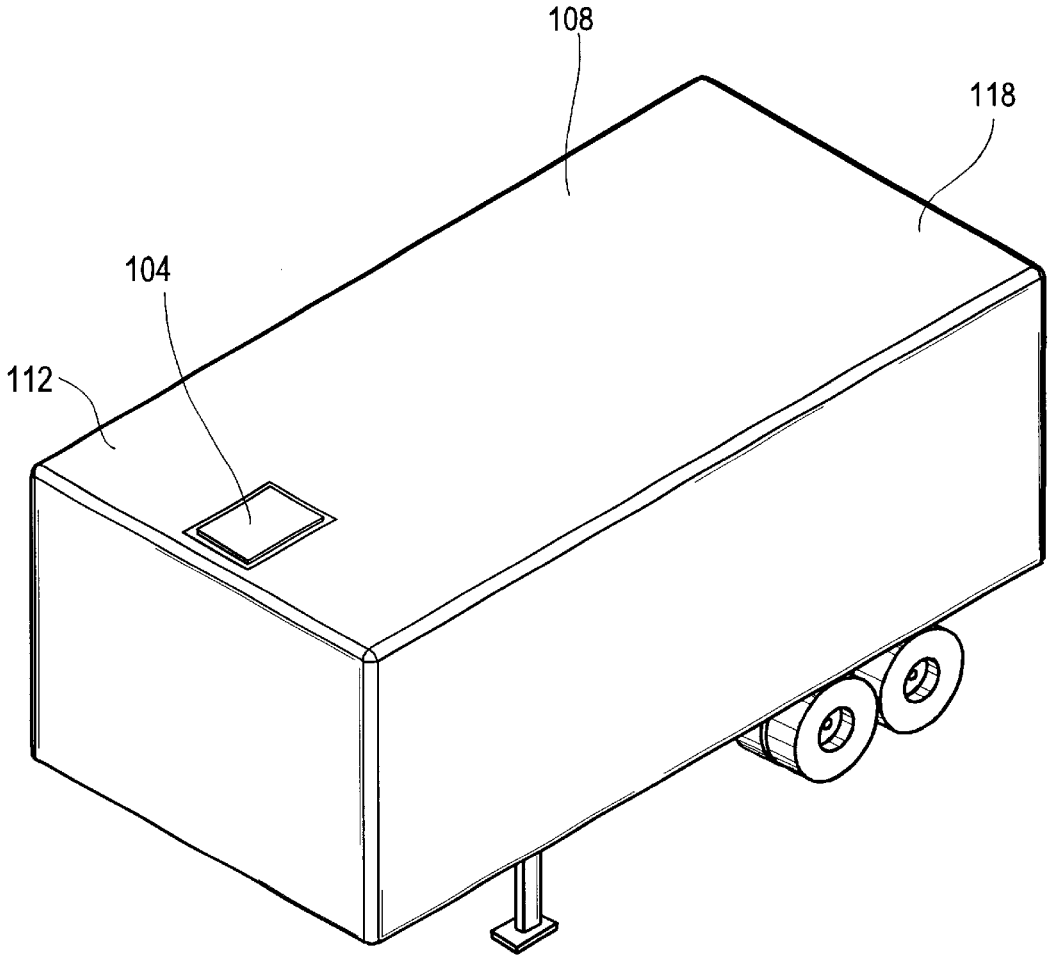
FIG. 1 is an illustration of a very low profile antenna in accordance with the present invention, installed on a trailer.

With reference to FIG. 1, an antenna system 104 according to the present invention is shown affixed to the top of a trailer 103. As shown in FIG. 1, the antenna system 104 is generally encased in a radome, and has a very low profile. When located as illustrated in FIG. 1, the antenna system 104 does not add to the height of the trailer 108. This is because the trailer 108 is, for aerodynamic purposes, approximately one inch lower at its front end 112 than at the rear 118. However, even when affixed to a trailer 108 not having a sloped top section, the antenna system 104 does not add appreciably to the height of the trailer. This is because the antenna system 104, in a preferred embodiment, has an overall height of less than about one inch. Also, it can be seen from FIG. 1 that the antenna system 104 is rectangular in shape, is without protrusions and is mounted flat against the top of the trailer 108.

Figure 2:
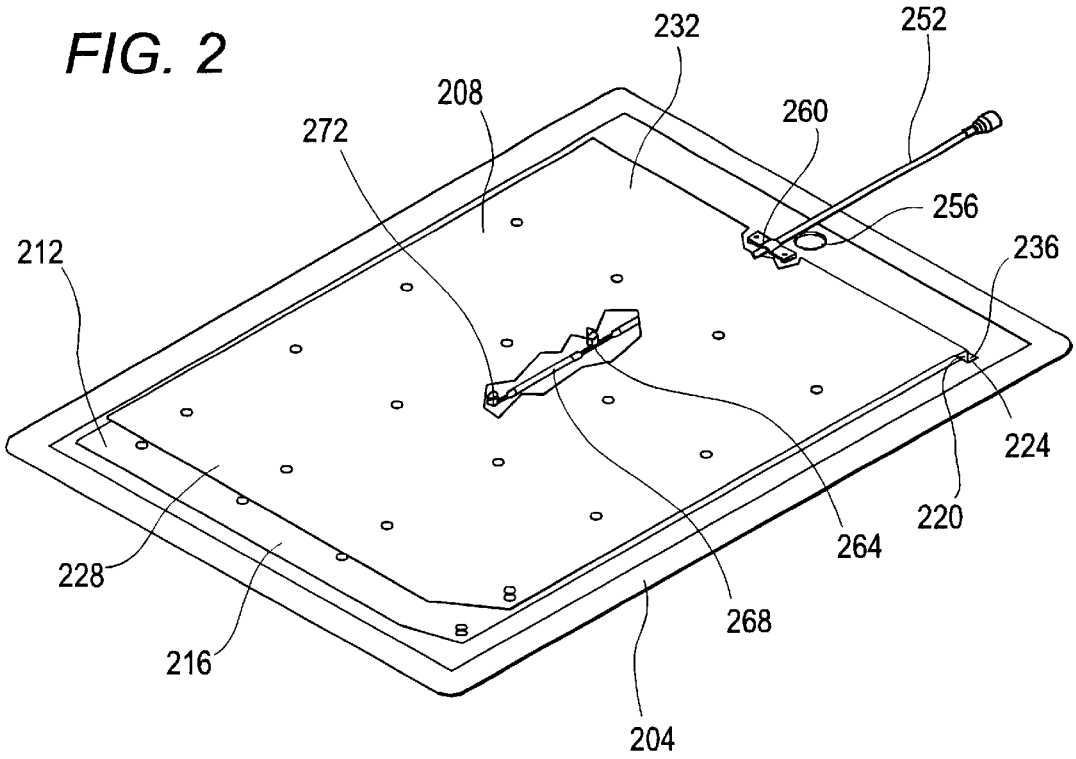
FIG. 2 is a top perspective view of an antenna system in accordance with an embodiment of the present invention.

Referring now to FIG. 2, the antenna system 104 of the present invention is illustrated with the radome removed. The antenna system 104 generally comprises a ground plane 204, a relatively rigid first antenna element 208 and a relatively rigid second antenna element 212. The ground plane 204 is substantially planar, and is rectangular in shape. Directly above and substantially parallel to the ground plane 204 is the second antenna element 212. The second antenna element 212 is substantially planar in shape, and features a first end portion 216 that is spaced apart from and generally parallel to the ground plane 204. At a second end portion 220 the second antenna element 212 turns down to join the ground plane 204 at tab 224. Accordingly, the second antenna element 212 is mechanically and electrically interconnected to the ground plane 204 at one end 220.

The first antenna element 208 has a first end portion 228 that is spaced apart from the second antenna element 212. In general, this first antenna element 208 is substantially parallel to the second antenna element 212. At a second end portion 232 of the first antenna element 208, the first antenna element 208 turns down to meet the second antenna element 212 and the ground plane 204 at tab 236. Accordingly, the first antenna element 208 is mechanically and electrically interconnected to the second antenna element 212 and the ground plane 204 at one end 232.

Also illustrated in FIG. 2 is the feed line 252, which interconnects the antenna system 104 to the transceiver (not shown). The feed line 252 passes through a hole 256 formed in the ground plane 204. After entering through the hole 256, the feed line 252 is held in position by a clamp 260 affixed to the ground plane 204. Clamp 260 also electrically interconnects the ground plane to the coaxial shield of the feed line 252. The feed line 252 then terminates at a first transmission connector 264, which conducts transmission signals to the first antenna element 208 from the feed line 252. A jumper 268 is also connected to the first transmission connector 264. The jumper 268 communicates radio frequency signals received by the second antenna element 212 through a second transmission connector 272 to the feed line 252. The length of the jumper 268 is chosen to facilitate the matching of the impedance of the second antenna element 212 to the impedance of the feed line 252 and the impedance of the transceiver (not shown). By providing matched impedances, the antenna system 104 can provide an antenna having low reflection losses for both the first antenna element 208, which is used to transmit radio frequency signals in the illustrated embodiment, and the second antenna element 212, which is used to receive radio frequency signals in the illustrated embodiment. Furthermore, the antenna system 104 is capable of doing so even where the first antenna element 208 and the second antenna element 212 have different operating frequencies and different physical properties and dimensions. For example, in one embodiment, the operating frequency of the first antenna element 208 may be in the range of about 148–150 MHz and the operating frequency of the second antenna element 212 may be in the range of about 137–138 MH.

Figure 3:
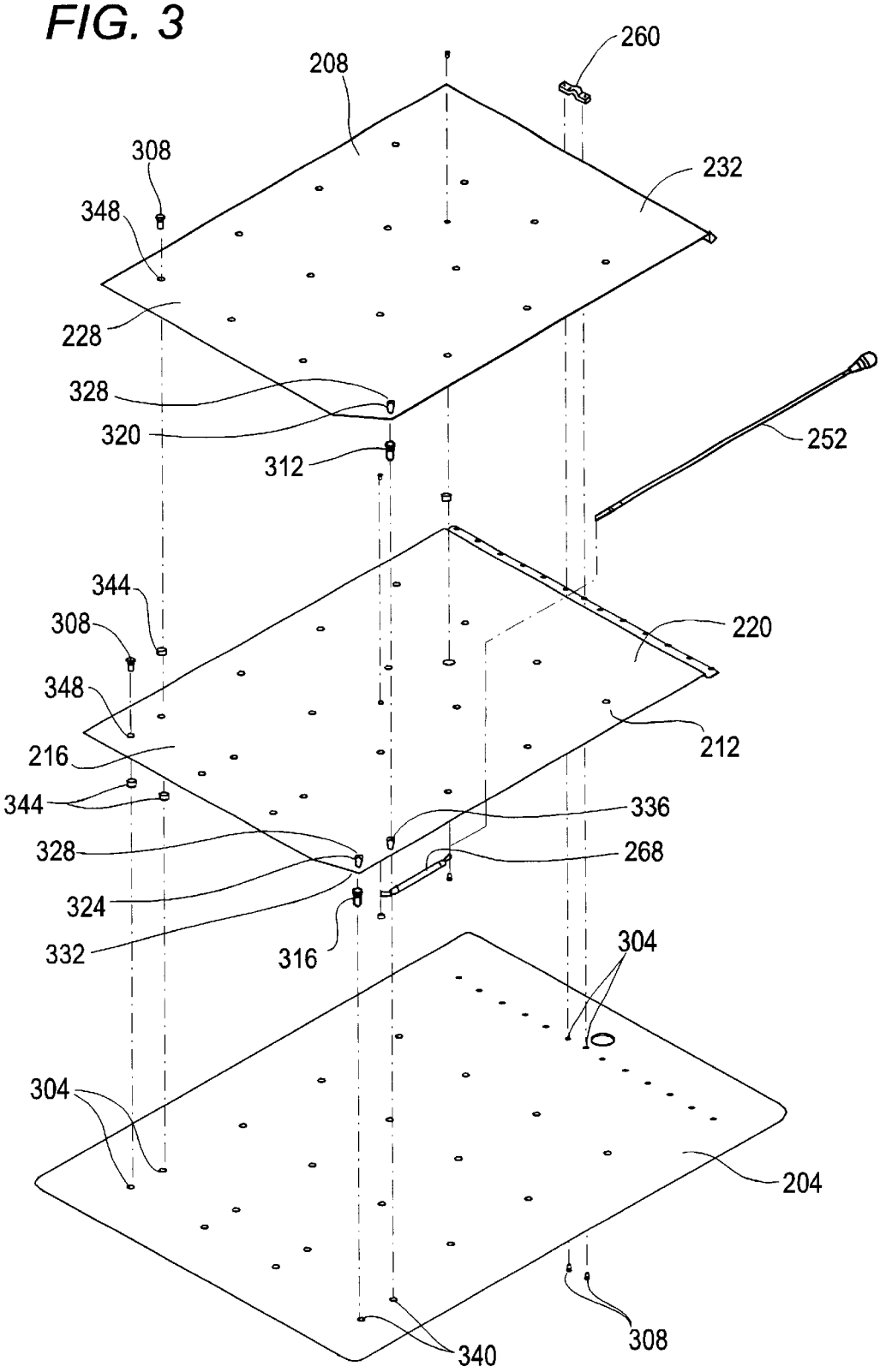
FIG. 3 is an exploded perspective view of an antenna system in accordance with the present invention.

Referring now to FIG. 3, the radiating antenna elements 208 and 212 and the ground plane 204 are illustrated in an exploded view. As shown in FIG. 3, it can be seen that the rectangular antenna elements 208 and 212 and the rectangular ground plane 204 are aligned such that their sides are substantially parallel to one another, and such that they occupy substantially parallel planes. Also illustrated in FIG. 3 is one method of affixing the second end portions 220 and 232 of the antenna elements 208 and 212 to the ground plane 204. Specifically, the clamp 260 receives fasteners 308, which pass through the ground plane 204, the tab 224 of the second antenna element 212, and the tab 236 of the first antenna element 208, to secure these components to one another.

A first tuning element 312 and a second tuning element 316 are located to engage the first antenna element 208 and the second antenna element 212 respectively, at holes 320 and 324 in the first end portions 216 and 228 of those elements 208 and 212. In the illustrated embodiment, the holes 320 and 324 are located in a corresponding corner of the first portions 216 and 228 of the first 208 and second 212 antenna elements. However, the tuning elements 312 and 316 may be placed anywhere on the antenna elements 208 and 212 that is sufficiently distal from the interconnection of the antenna elements 208 and 212 to the ground plane 204 that adjustments to the tuning elements 312 and 316 are effective in varying the heights of substantial portions of the antenna elements 208 and 212 above the ground plane 204.

Figure 4:
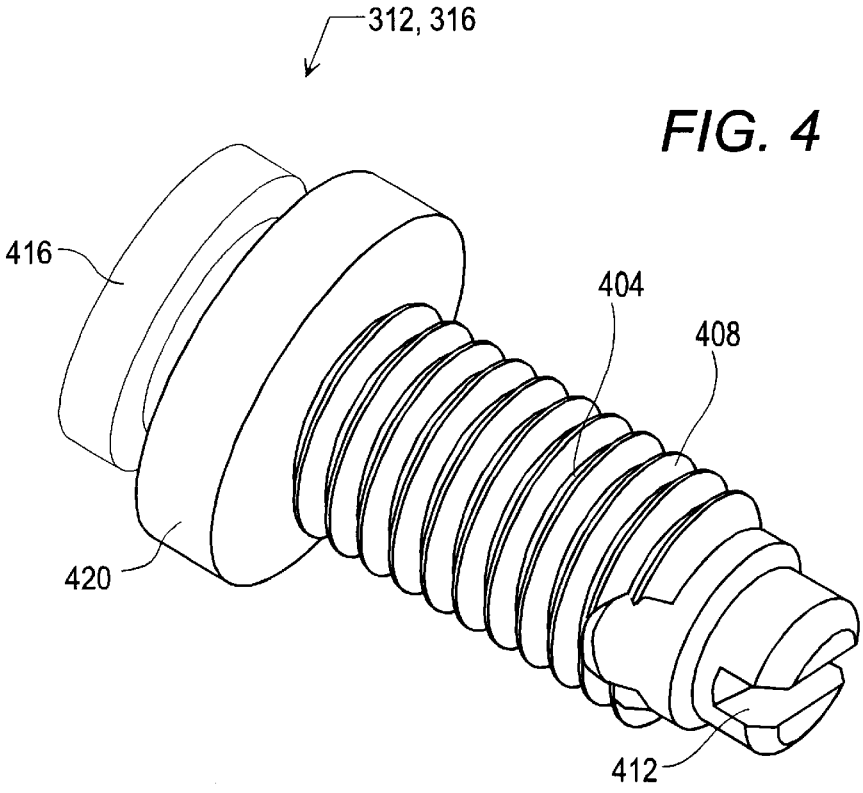
FIG. 4 is a perspective view of a tuning element in accordance with the present invention.

Referring now to FIG. 4, the design of the tuning elements 312 and 316 is illustrated in detail. The tuning elements 312 and 316 generally include a shaft 404, threads 408, a slotted tip 412, a first enlarged head 416 and a second enlarged head 420. The slotted tip 412 of the tuning element 312 and 316 is adapted to receive a screwdriver when fine tuning of the antenna is desired. Alternatively, the slotted tip 412 may comprise a hexagonal head for turning by a socket, or any other known method for providing a fixture that can be turned by a tool or directly by hand. The first enlarged head 416 of the antenna tuning element 312 and 316 is separated from the second head 420 by an extension of the shaft 404. The distance between the heads 416 and 420 is determined by the thickness of the antenna element 208 and 212 that is to be received between them. According to one embodiment, the first head 416 is provided with a slot or recess or other shape for interconnection with a tool adapted to impart rotation to an element. The provision of such a fixture is useful in the assembly of the antenna 104. In a preferred embodiment, the tuning element 312, 316 is constructed from a nonconductive material. For example, the tuning elements 312,316 may be constructed from nylon.

Referring again to FIG. 3, the slotted holes or openings 320 and 324 comprise first enlarged portions 328 sized to allow a first head 416 of the antenna tuning elements 312 and 316 to pass through. The holes 320 and 324 are further provided with a narrowed portion 332 having a width that is approximately equal to the diameter of the shaft 404 of the tuning elements 312 and 316. A clearance hole 336 is provided in the first end portion 216 of the second antenna element 212 to allow the first tuning element 312 to pass through the second antenna element 212 and engage the first of two threaded holes 340 provided in the ground plane 204. The second tuning element 316 engages the second hole 340 in the ground plane 240.

The first and second antenna elements 203 and 212 are spaced apart from each other and from the ground plane 204 by non-conductive spacers or bushings 344. In the illustrated embodiment, the spacers 344 are generally located in a second corner of the first portion 216 and 223 of the first 208 and second 212 antenna elements. Fasteners 308 are passed through the holes 348 in the first 208 and second 212 antenna elements to engage the ground plane 204 at the provided holes 304.

Figure 5:
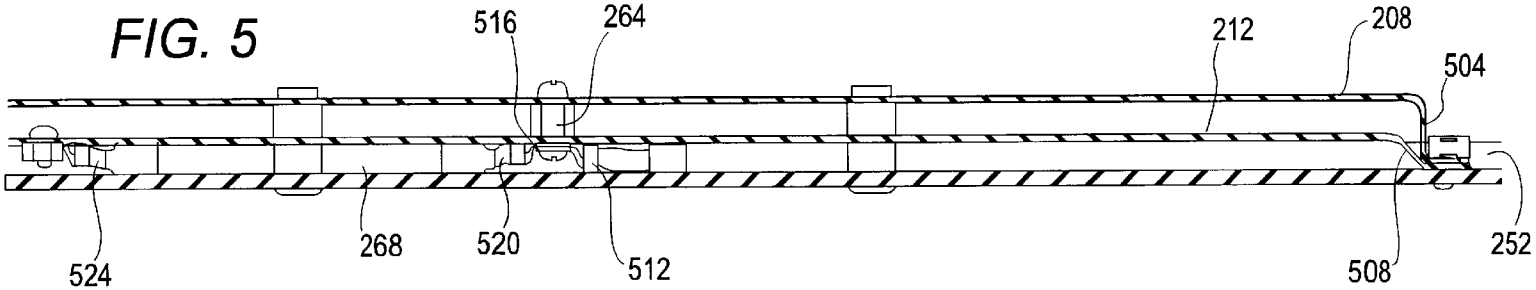
FIG. 5 is a partial side view of an antenna system according to an embodiment of the present invention illustrating the interconnections between the antenna feed line and the first and second antenna elements.

Referring now to FIG. 5, the transmission feed line 252 and its interconnections to the first 208 and the second 212 antenna elements are shown. The antenna feed line 252 passes through holes 504 and 508, formed in the first 208 and second 212 antenna elements, and proceeds between the second antenna element 212 and the ground plane 204 to a point generally towards the middle of the antenna system 104. The antenna feed line 252 is interconnected to the first antenna element 208 through a first terminal connector 512 that is connected to a first transmission connector 264, which passes through a hole 516 formed in the second antenna element 212 to connect to the first antenna element 208. In the illustrated embodiment of the antenna system 104 of the present invention, the first transmission connector 264 carries transmission signals from the transceiver through the feed line 252 and to the first antenna element 208 for transmission. Also interconnected to the first transmission connector 264 is a second terminal connector 520, which is interconnected to a jumper cable 268. The jumper cable 268 terminates in a third terminal connector 524, which is interconnected to the second antenna element 212. In the illustrated embodiment of the antenna system 104 of the present invention, the second antenna element 212 is adapted to receive radio frequency signals and to communicate those signals to the transceiver (not shown) through the jumper cable 268 and the feed line 252.

Because the first antenna element 208 and the second antenna element 212 are, in one embodiment, adapted to transmit or receive in different frequency ranges, they differ from one another in size. This results in the antenna elements 208 and 212 having differing characteristic impedances. In any electronic system, it is desirable to match the characteristic impedances of the various components to reduce losses and therefore reduce power demands in the system. According to the present invention, the characteristic impedance of the first antenna element 208 is matched to the characteristic impedance of the feed line 252 and the transceiver. The jumper 268 in effect alters the characteristic impedance of the second antenna element 212 seen by the feed line 252 and the transceiver. By carefully choosing the length of the jumper cable 268, the characteristic impedances of the first antenna element 203, the second antenna element 212, the feed line 252 and the transceiver can all be matched.

Figure 6:
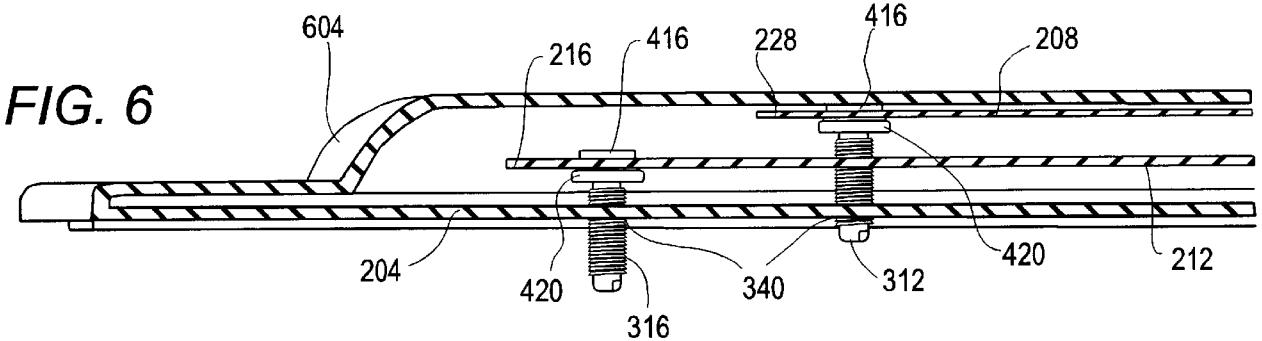
FIG. 6 is a partial side view of an antenna system according to an embodiment of the present invention showing the tuning elements in a first position.

Referring now to FIG. 6, the first 312 and second 316 tuning elements are shown in elevation in a first position. It can be seen that the first antenna element 208 is held between the first 416 and second 420 heads of the first tuning element 312. By screwing the tuning elements 312 and 316 in or out of the threaded hole 340 provided in the ground plane 204, the height of the antenna elements 208 and 212 will be changed in relation to the ground plane 204. By adjusting the tuning elements 312 and 316 individually, the height of a corresponding 20 one of the antenna elements 208 or 212 can be adjusted with respect to the ground plane 204 and to the other antenna element 208 or 212. In this first position, illustrated in FIG. 6, the first end portions 216 and 228 of the antenna elements 208 and 212 can be seen to be substantially parallel to the ground plane 204. Also, in this first position, the first end portions 216 and 228 are substantially perpendicular to the tuning elements 312 and 316.

Also illustrated in FIG. 6 is the radome 604 of the antenna system 104, shown partially cutaway. The radome 604 generally rises from the ground plane 204 to envelope the antenna elements 208 and 212. At the interface between the radome 604 and the ground plane 204, the joint is preferably made water tight by application of a sealant or adhesive.

Figure 7:
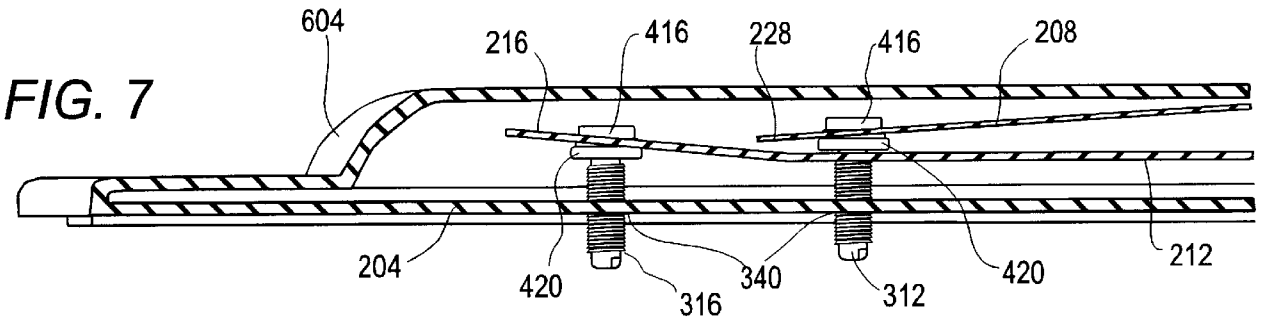
FIG. 7 is a partial side view of an antenna system according to an embodiment of the present invention showing the tuning elements in a second position.

In FIG. 7, the first 312 and second 316 tuning elements are illustrated in a second position. As shown in FIG. 7, the first antenna element 208 and the second antenna element 212 are not parallel to each other along their first portions 216 and 228. The first portions 216 and 228 are also not parallel to the ground plane 204. Furthermore, the first end portions 216 and 228 of the antenna elements 208 and 212 are not perpendicular to the tuning elements 312 and 316. According to one embodiment of the present invention, at an extreme of adjustment, the first end portions 216 and 228 are at an angle of from 85° to 95° to the tuning elements 312 and 316. This is a result of a bending of the first 208 and second 212 antenna elements by adjusting the first 312 and second 316 tuning elements. This is in contrast to the first position of the first tuning element 312 and second tuning element 316 illustrated in FIG. 6, in which the first portions 216 and 228 of the antenna elements 208 and 212 are substantially parallel to one another and parallel to the ground plane 204, and substantially perpendicular to the tuning elements 312 and 316.

The first position of the antenna tuning elements 312 and 316 illustrated in FIG. 6 represents a starting point for the adjustment of the operative frequencies of the tuning elements 208 and 212. Because the operating frequency of a patch antenna such as the antenna system 104 the present invention is determined by the height and length of the antenna element, that frequency can be adjusted by altering the height of the element above the ground plane. Where there is more than one antenna element, such as in the antenna system 104 illustrated in FIG. 6, the operating frequencies of each of the antenna elements 208 and 212 must be individually tuned. Furthermore, adjustments to the height of one of the antenna elements 208 and 212 above the ground plane 204 also changes the distance of that element from the other antenna element, affecting the operating frequency of that other element. Accordingly, the actual tuning of a multiple element antenna is an iterative process in which the individual elements are alternately tuned until the operating frequencies of each of the elements is satisfactory.

At extremes of adjustment, the distance between the antenna elements 208 and 212 and/or the ground plane 204 may become quite small. Such a configuration is illustrated in FIG. 7, where the first 208 and second 212 antenna elements are very close together. In particular, it can be seen that the first portion 216 of the second antenna element 212 turns about the second head 420 of the first tuning element 312 before extending to meet the second tuning element 316. The second head 420 of the first tuning element 312 thus prevents the first 208 and second 212 antenna elements from being shorted to one another as a result of the adjustment. A short circuit between the antenna elements 208 and 212 would render them useless at their intended operating frequencies.

Although the relationship illustrated in FIG. 7 is an extreme, short circuit protection is provided by the unique design of the antenna tuning elements 312 and 316. Specifically, the two head 416 and 420 design of the tuning elements 312 and 316 positively prevents the antenna elements 208 and 212 from moving relative to the tuning elements 312 and 316 Accordingly, the antenna system 104 provides a tunable antenna system that is reliable in environments having a significant amount of vibration.

Figure 8:
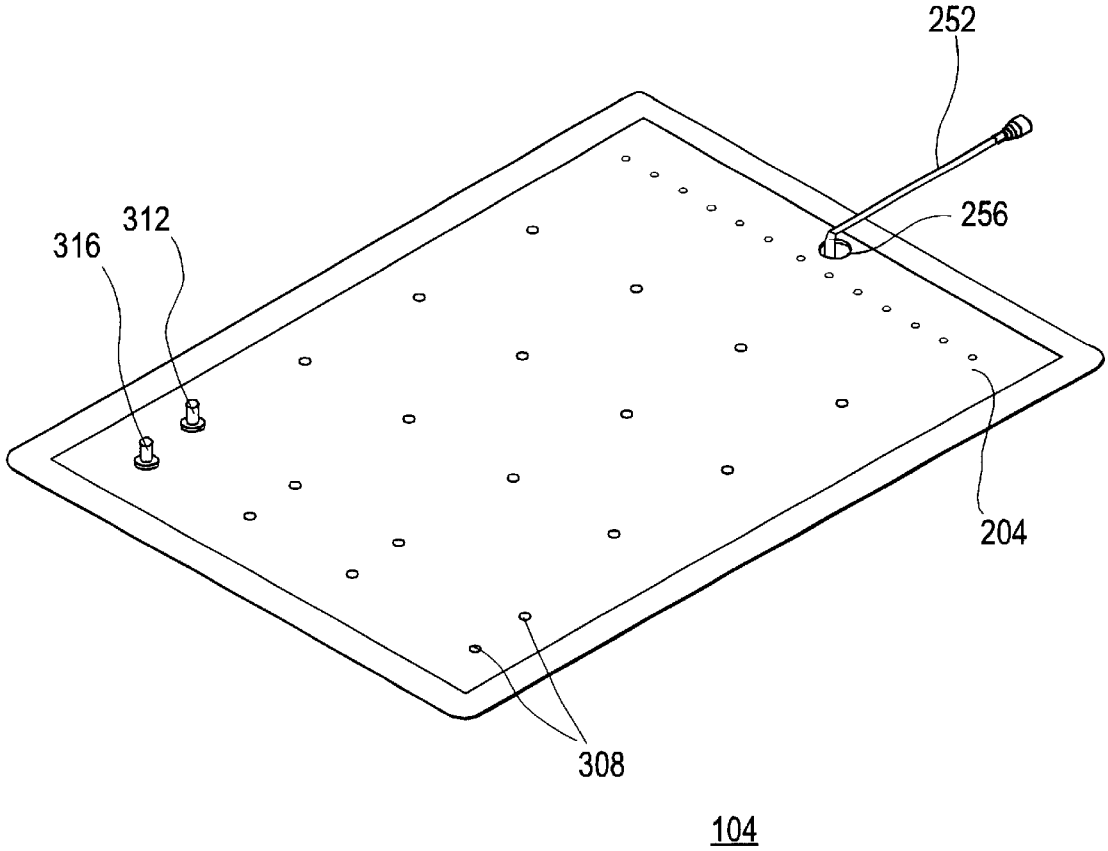
FIG. 8 is a bottom perspective view of an antenna system in accordance with the present invention.

Referring now to FIG. 8, a bottom perspective view of an antenna constructed in accordance with an embodiment of the present invention is illustrated. In FIG. 8, the antenna tuning elements 312 and 316 are shown extending slightly from the ground plane 204. Therefore, it is evident that the antenna tuning elements 312 and 316 are accessible even when the radome 604 is affixed to the ground plane 204. Also illustrated in FIG. 8 are the bottoms of the fasteners 308. In order to tune the antenna system 104, the feed cable 252 is interconnected to a test transceiver (not shown) and radio wave signals are transmitted and received by the antenna system 104. An operator turns the first tuning element 312 to adjust the frequency at which the first antenna element 208 is most sensitive. The second tuning element 316 is then turned to adjust the operating frequency of the second antenna element 212. Because adjusting the tuning of the second antenna element affects the tuning of the first antenna element, the operable frequency of the first antenna element is checked and readjusted if necessary. Then, the second antenna element's operable frequency is re-checked and adjusted as necessary. This process continues until both elements are tuned to the desired operating frequencies.

In a preferred embodiment, the antenna system 104 is placed on a second ground plane (not shown) having dimensions approximating that of the top of a trailer. Holes corresponding to the positions of the antenna tuning elements 312 and 316 are provided in the second ground plane to permit access to the tuning elements 312 and 316. The antenna system 104 is then tuned as described above. By tuning the antenna system 104 on this second ground plane, the operating frequencies of the antenna elements 208 and 212 can be more precisely determined and adjusted. This is because the provision of the ground plane allows the test environment to closely approximate the actual operating environment of the antenna system 104.

After the radome 240 has been glued or otherwise affixed to the ground plane 204, sealing the antenna system 104 against intrusion by water or dust, and the antenna system has been tuned, the antenna tuning elements 312 and 316 can be permanently fixed in position. The antenna tuning elements 312 and 316 can be permanently fixed using glue or ultrasonic welding.

According to an embodiment of the present invention for use with a first antenna element 208 having an operating frequency of 148 to 150 MHz and a second antenna element 212 having an operating frequency of 137 to 138 MHz the ground plane 204 is about 465 mm in length, and about 380 mm in width. The first antenna element 208 is about 500 mm length, and about 380 mn in width. The second antenna element 212 is about 530 mm in length, and about 380 mm in width. The first antenna element 208 is about 5.3 mm from the second antenna element 212, which is about 5.3 mm from the ground plane 204. In a preferred embodiment, the antenna elements 208 and 212 and the ground plane 204 are constructed from an electrically conductive material. In a more preferred embodiment, the antenna elements 208 and 212 and the ground plane 204 are constructed from aluminum. The radome 604 of the present invention is preferably constructed from a material that is transparent to radio frequency waves. In a preferred embodiment, the radome 604 is constructed from an ABS/PVC composite sheet.

In accordance with the present invention, a very low profile antenna that can be very precisely tuned is provided. The invention in its broader aspects relates to a low profile antenna that can be very precisely tuned. The antenna is suitable for use in any application requiring an antenna having a high sensitivity over a narrow range of frequencies, and a low or very low profile. The apparatus can be easily and accurately tuned and is designed to operate reliably, even in an environment such as the exterior of a trailer.

The foregoing discussion of the invention has been presented for purposes of illustration and description. Further, the description is not intended to limit the invention to the form disclosed herein. Consequently, variations and modifications commensurate with the above teachings, within the skill and knowledge of the relevant art, are within the scope of the present invention. The embodiments described hereinabove are further intended to explain the best mode presently known of practicing the invention and to enable others skilled in the art to utilize the invention in such or in other embodiments and with various modifications required by their particular application or use of the invention. It is intended that the appended claims be construed to include alternative embodiments to the extent permitted by the prior art.

What is claimed is:

1. An antenna system, comprising:

a planar first antenna element including a planar first end portion, whereon said planar first antenna element has a width and a length, wherein said width is at least one-half as great as said length, and wherein said planar first antenna element has a lower surface;

a planar second antenna element including a planar first end portion, with said second antenna element being spaced from said first antenna element, wherein said planar second antenna element has a width and a length wherein said width is at least one-half as great as said length wherein said planar second antenna element has an upper surface, and wherein a majority of said lower surface of said planar first antenna element overlays a majority of said upper surface of said planar second antenna element;

a ground member spaced from at least substantial portions of each of said first and second antenna elements; and at least a first tuning element having a length with a center axis, said first tuning element being connected to and extending through said first antenna element, said first tuning element having first and second positions, when said first tuning element is in said first position, said center axis is perpendicular to said planar first end portion and when said first tuning element is in said second position, said planar first end portion of said planar first antenna element is at an angle different from perpendicular to said center axis.

2. An antenna system, as claimed in claim 1, further including:

an enclosure member that is disposed about at least said first antenna element and said second antenna element.

3. An antenna system, as claimed in claim 1, wherein:

when said first tuning element is in said second position, said planar first end portion of said planar first antenna element is at an angle, non-parallel to substantial portions of said first antenna element.

4. An antenna system, as claimed in claim 1, wherein:

said angle different from perpendicular is in the range of about 85° to 95°.

5. An antenna system, as claimed in claim 1, wherein:

said first antenna element has a length and a width and in which said width is at least 80% of said length.

6. An antenna system, as claimed in claim 1, wherein:

said first tuning element includes a shaft and first and second heads, with a shaft portion disposed between said first and second heads, said first head being disposed adjacent an upper surface of said first antenna element and said second head being adjacent a lower surface of said first antenna element, with said second head for use in preventing a short circuit between said first and second antenna elements.

7. An antenna system, as claimed in claim 1, wherein:

said first antenna element has a first predetermined frequency associated therewith in connection with transmitting a signal, said first and second antenna elements being substantially parallel to each other and defining a distance therebetween, with said distance being less than $1/300^{th}$ of a wavelength and said wavelength being related to said first predetermined frequency.

8. An antenna system, as claimed in claim 7, wherein:

said distance is about $1/400^{th}$ of a wavelength and said first predetermined frequency is about 148–150 MH.

9. An antenna system comprising:

a planar first antenna element including a planar first end portion;

a planar second antenna element including a planar first end portion with said second antenna element being spaced from said first antenna element;

a ground member spaced from at least substantial portions of each of said first and second antenna elements;

at least a first tuning element having a length with a center axis said first tuning element being connected to and extending through said first antenna element, said first tuning element having first and second positions, when said first tuning element is in said first position, said center axis is perpendicular to said planar first end portion and when said first tuning element is in said second position, said planar first end portion of said planar first antenna element is at an angle different from perpendicular to said center axis; and said first tuning element includes a shaft, a first enlarged segment and a second enlarged segment, with each of said first and second enlarged segments having a width, each of said first and second enlarged segment widths being greater than said shaft width, said second enlarged segment being disposed between said first and second antenna elements.

10. An antenna system comprising:

a planar first antenna element including a planar first end portion;

a planar second antenna element including a planar first end portion, with said second antenna element being spaced from said first antenna element;

a ground member spaced from at least substantial portions of each of said first and second antenna elements;

at least a first tuning element having a length with a center axis, said first tuning element being connected to and extending through said first antenna element, said first tuning element having first and second positions, when said first tuning element is in said first position, said center axis is perpendicular to said planar first end portion and when said first tuning element is in said second position, said planar first end portion of said planar first antenna element is at an angle different from perpendicular to said center axis; and a feed cable assembly for carrying transmit and receive signals relative to said first and second antenna elements, said feed cable assembly including a first antenna connection member connected to said first antenna element, a second connection member connected to said second antenna element and a jumper member extending substantially parallel to said first and second antenna elements from adjacent said first antenna connection member to said second antenna connection member and in which said jumper member has a length that is determined based on impedance matching related to said second antenna element and said feed cable assembly.

11. An antenna system, comprising:

at least a first antenna element;

a ground member having substantial portions spaced from said first antenna element;

a first tuning element connected to and extending through said first antenna element, said first tuning element including first and second heads and a shaft connected to said first and second heads and with a shaft portion defined between said first and second heads and having a width smaller than widths of each of said first and second heads, said first antenna element having an upper surface and a lower surface, said first head being adjacent to said upper surface and said second head being adjacent to said lower surface, wherein at least said second head is used to reduce loosening of said first tuning element from said first antenna element;

a second antenna element spaced a distance from said first antenna element, with said first and second antenna elements being substantially parallel and said distance being less than $1/300^{th}$ of a wavelengh and said wavelength being related to a first predetermined frequency of said first antenna element; and a feed cable assembly for carrying a transmit signal to said first antenna element and a receive signal from said second antenna element, said feed cable assembly including first and second antenna connection members and a jumper member having a length that extends between said first and second antenna connection members.

12. An antenna system, as claimed in claim 11, wherein:

said first antenna element has a slotted opening with first and second enlarged portions, with said first enlarged portion being greater in size than said second enlarged portion, wherein said first head of said first tuning element can be located through said first enlarged portion and said first tuning element can be moved such that said shaft portion is positioned through said second enlarged opening.

13. An antenna system, as claimed in claim 12, wherein:

said slotted opening is located adjacent a first end portion of said first antenna element, said first end portion is defined as having first and second positions, said first position being perpendicular to a center axis ofsaid first tuning element and a second position being different from perpendicular to said center axis, said first end portion being in said second position when said first antenna element is tuned to a first predetermined frequency.

14. An antenna system, as claimed in claim 11, wherein:

said first antenna element has a length and a width, with said width being at least 80% of said length.

15. A method for tuning an antenna system, comprising:

providing an antenna apparatus including first and second antenna elements, a ground member and at least a first tuning element adjustably connectable to said first antenna element and said ground member, joining an enclosure member to said antenna apparatus; and adjusting said first antenna element to a first predetermined frequency after said joining step.

16. A method, as claimed in claim 15, wherein:

said providing step includes locating said first tuning element in a first enlarged hole of a slotted opening in said first antenna element and then moving said first tuning element to a second enlarged hole in said slotted opening.

17. A method, as claimed in claim 15, wherein:

said providing step includes holding said ground member using a fixture after said first antenna element is held by said fixture and said joining step includes bonding said enclosure member to said ground member using adhesive provided on said ground member.

18. A method, as claimed in claim 15, wherein:

said adjusting step includes using a tool contacting a shaft of said first tuning element in moving said first tuning element in order to associate a first predetermined frequency with said first antenna element.

19. A method, as claimed in claim 15, wherein:

said providing step includes providing a second tuning element and a second antenna element, adjusting said second tuning element to associate a second predetermined frequency with said second antenna element and then re-adjusting said first tuning element in associating said first predetermined frequency with said first antenna element.

* * * * *